US009983490B2

(12) United States Patent
Shimada et al.

(10) Patent No.: US 9,983,490 B2
(45) Date of Patent: May 29, 2018

(54) ELECTROPHOTOGRAPHIC APPARATUS

(71) Applicant: CANON KABUSHIKI KAISHA, Tokyo (JP)

(72) Inventors: Tsuyoshi Shimada, Toride (JP); Ryoichi Tokimitsu, Kashiwa (JP); Mai Murakami, Kashiwa (JP); Kan Tanabe, Matsudo (JP); Wataru Kitamura, Abiko (JP); Haruhiko Mitsuda, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/469,935

(22) Filed: Mar. 27, 2017

(65) Prior Publication Data

US 2017/0285499 A1 Oct. 5, 2017

(30) Foreign Application Priority Data

Mar. 31, 2016 (JP) ..... 2016-071653
Mar. 8, 2017 (JP) ..... 2017-043966

(51) Int. Cl.
*G03G 5/00* (2006.01)
*G03G 5/14* (2006.01)
*G03G 15/02* (2006.01)

(52) U.S. Cl.
CPC ..... *G03G 5/144* (2013.01); *G03G 5/14* (2013.01); *G03G 5/142* (2013.01);
(Continued)

(58) Field of Classification Search
CPC ..... G03G 15/0216; G03G 5/14; G03G 5/142; G03G 5/144
(Continued)

(56) References Cited

U.S. PATENT DOCUMENTS 5,198,685 A 3/1993 Kitani et al.
5,876,890 A 3/1999 Kitamura et al.
(Continued)

FOREIGN PATENT DOCUMENTS

JP 2006-221094 8/2006
JP 2013-137518 7/2013

OTHER PUBLICATIONS

U.S. Appl. No. 15/077,185, Koji Takahashi, filed Mar. 22, 2016.
U.S. Appl. No. 15/315,869, Koji Takahashi, filed Dec. 2, 2016.
U.S. Appl. No. 15/413,759, Satoshi Arimura, filed Jan. 24, 2017.
U.S. Appl. No. 15/506,319, Wataru Kitamura, filed Feb. 24, 2017.

*Primary Examiner* — Mark A Chapman
(74) *Attorney, Agent, or Firm* — Fitzpatrick Cella Harper and Scinto

(57) ABSTRACT

The present invention provides an electrophotographic apparatus in which the deterioration of electrical properties in repetitive use is suppressed even in the case where an electrophotographic photosensitive member absorbs moisture under a high-temperature and high-humidity environment. An undercoat layer of the electrophotographic photosensitive member provided in the electrophotographic apparatus contains (α) a metal oxide particle, (β) a particular benzophenone compound and (γ) a compound represented by the following formula (2).

(2)

(Continued)

wherein $R^{11}$ to $R^{15}$ each independently represent a hydrogen atom, a hydroxy group, a halogen atom, an alkyl group, an alkoxy group or an amino group and $A^1$ represents an alkenyl group having 2 or more and 4 or less carbon atoms.

12 Claims, 1 Drawing Sheet

(52) U.S. Cl.
CPC ..... *G03G 15/0216* (2013.01); *G03G 2215/00957* (2013.01); *G03G 2215/025* (2013.01)

(58) Field of Classification Search
USPC ..... 430/60, 63, 65
See application file for complete search history.

(56) References Cited

U.S. PATENT DOCUMENTS

| | | | |
|---|---|---|---|
| 5,912,098 | A | 6/1999 | Tanaka et al. |
| 6,183,922 | B1 | 2/2001 | Takai et al. |
| 6,218,063 | B1 | 4/2001 | Tanaka et al. |
| 6,335,132 | B1 | 1/2002 | Tanaka et al. |
| 6,405,005 | B1 | 6/2002 | Kitamura et al. |
| 7,645,547 | B2 | 1/2010 | Okuda et al. |
| 7,655,370 | B2 | 2/2010 | Kitamura et al. |
| 7,813,675 | B2 | 10/2010 | Tanabe et al. |
| 9,594,318 | B2 | 3/2017 | Nakata et al. |
| 2014/0004450 | A1 | 1/2014 | Tokimitsu et al. |
| 2015/0346620 | A1 | 12/2015 | Kitamura et al. |
| 2016/0327876 | A1 | 11/2016 | Miyauchi et al. |
| 2017/0090309 | A1 | 3/2017 | Murakami et al. |

ELECTROPHOTOGRAPHIC APPARATUS

BACKGROUND OF THE INVENTION

Field of the Invention

The present invention relates to an electrophotographic apparatus.

Description of the Related Art

In recent years, electrophotographic apparatuses employing a contact charging system in which voltage is applied to a charging member (contact charging member) disposed so as to abut on an organic electrophotographic photosensitive member (hereinafter, referred to as "electrophotographic photosensitive member") to charge the electrophotographic photosensitive member have become widespread.

Particularly, a system (AC/DC contact charging system) in which a charging roller that is a charging member in a roller form is used, the charging roller is made to abut on the surface of an electrophotographic photosensitive member, and voltage obtained by superposing an alternating-current voltage on a direct-current voltage is applied to the charging roller to charge the electrophotographic photosensitive member (AC/DC contact charging system) or a system (DC contact charging system) in which voltage composed of only a direct-current voltage is applied to the charging roller to charge the electrophotographic photosensitive member has become the mainstream.

The AC/DC contact charging system requires a direct-current power source and an alternating-current power source and therefore has problems that an increase in cost of an electrophotographic apparatus itself is brought about and the size of an electrophotographic apparatus becomes large when compared with the DC contact charging system. Accordingly, it can be said that the DC contact charging system is more preferable taking cost reduction and miniaturization of an electrophotographic apparatus into consideration.

Moreover, electrophotographic photosensitive members including an undercoat layer and a photosensitive layer on a support are widely used as an electrophotographic photosensitive member included in an electrophotographic apparatus. An organic compound is added to the undercoat layer together with a metal oxide particle for the purpose of stabilizing electrical properties, suppressing deficiency in image quality and images, or other purposes.

Japanese Patent Application Laid-Open No. 2006-221094 discloses a technology in which an acceptor compound such as an anthraquinone compound is contained together with a metal oxide in the undercoat layer of an electrophotographic photosensitive member. It is disclosed that the acceptor compound having a group that can react with the metal oxide is particularly preferable and image defects such as a ghost phenomenon and fogging are suppressed by imparting an acceptor property to the undercoat layer. Furthermore, Japanese Patent Application Laid-Open No. 2013-137518 discloses a technology that suppresses a ghost phenomenon with a metal oxide particle and a benzophenone compound having a hydroxy group or an amino group each contained in the undercoat layer of an electrophotographic photosensitive member. It is inferred that an organic compound having such a substituent interacts with the metal oxide to make the acceptance and donation of electrons between metal oxide particles in the undercoat layer or from a photosensitive layer to the undercoat layer smooth.

SUMMARY OF THE INVENTION

The present inventors have further conducted studies on the technology for suppressing the ghost phenomenon by a particular benzophenone compound contained in the undercoat layer to find that there is room for more excellently improving the electrical properties in repetitive use in the case where an electrophotographic photosensitive member is placed under a high-temperature and high-humidity environment to absorb moisture, while maintaining a satisfactory ghost-suppressing property.

The present invention is directed to providing an electrophotographic apparatus which is provided with a DC contact charging system and which includes an electrophotographic photosensitive member whose electrical properties are satisfactory in repetitive use even in the case where the electrophotographic photosensitive member absorbs moisture under a high-temperature and high-humidity environment while suppressing a ghost phenomenon.

According to one aspect of the present invention, there is provided an electrophotographic apparatus comprising: an electrophotographic photosensitive member; a charging roller disposed so as to abut on the electrophotographic photosensitive member; and a charging unit charging the electrophotographic photosensitive member by applying only a direct-current voltage, in which the electrophotographic photosensitive member includes: a support; a photosensitive layer; and an undercoat layer between the support and the photosensitive layer, in which the undercoat layer includes:

(α) a metal oxide particle;

(β) a benzophenone compound represented by the following formula (1); and (γ) a compound represented by the following formula (2).

(1)

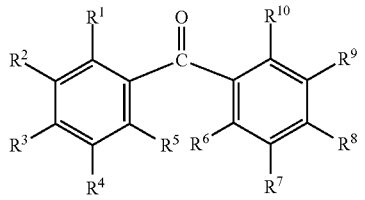

wherein $R^1$ to $R^{10}$ each independently represent a hydrogen atom, a hydroxy group, a halogen atom, an alkyl group, an alkoxy group or an amino group, provided that at least one of $R^1$ to $R^{10}$ is a hydroxy group.

(2)

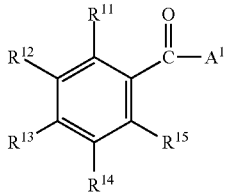

wherein $R^{11}$ to $R^{15}$ each independently represent a hydrogen atom, a hydroxy group, a halogen atom, an alkyl group, an alkoxy group or an amino group and $A^1$ represents an alkenyl group having 2 or more and 4 or less carbon atoms.

According to another aspect of the present invention, there is provided a process for producing an electrophotographic photosensitive member including: a support; a photosensitive layer; and an undercoat layer between the support and the photosensitive layer, the process including forming a coating film through coating with a coating liquid for an undercoat layer and drying the coating film, thereby forming the undercoat layer, in which the coating liquid for an undercoat layer includes:

(α) a metal oxide particle;

(β) a benzophenone compound represented by the following formula (1);

(γ) a compound represented by the following formula (2); and (δ) water, and a water content of the coating liquid for an undercoat layer is 2% by mass or more and 10% by mass or less relative to a total mass of the coating liquid for an undercoat layer.

(1)

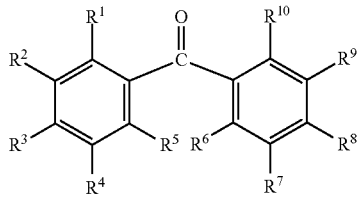

wherein $R^1$ to $R^{10}$ each independently represent a hydrogen atom, a hydroxy group, a halogen atom, an alkyl group, an alkoxy group or an amino group, provided that at least one of $R^1$ to $R^{10}$ is a hydroxy group.

(2)

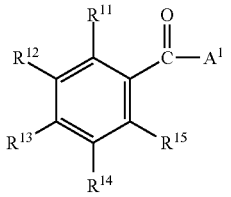

wherein $R^{11}$ to $R^{15}$ each independently represent a hydrogen atom, a hydroxy group, a halogen atom, an alkyl group, an alkoxy group or an amino group and $A^1$ represents an alkenyl group having 2 or more and 4 or less carbon atoms.

According to the present invention, an electrophotographic apparatus which is provided with a DC contact charging system and which includes an electrophotographic photosensitive member whose electrical properties are satisfactory in repetitive use even in the case where the electrophotographic photosensitive member absorbs moisture under a high-temperature and high-humidity environment while suppressing a ghost phenomenon can be provided.

Further features of the present invention will become apparent from the following description of exemplary embodiments with reference to the attached drawings.

DESCRIPTION OF THE EMBODIMENTS

Figure 1:
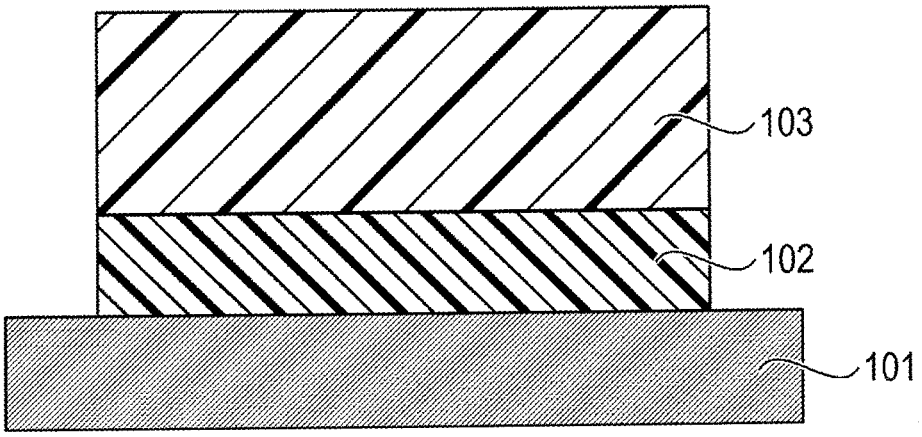
FIG. 1 is a diagram illustrating an example of a layer configuration of an electrophotographic photosensitive member included in an electrophotographic apparatus according to the present invention.

Preferred embodiments of the present invention will now be described in detail in accordance with the accompanying drawings.

In an electrophotographic photosensitive member included in an electrophotographic apparatus according to the present invention, an undercoat layer contains at least (α), (β) and (γ).

(α) is a metal oxide particle. As the metal oxide particle according to the present invention, any oxide may be used as long as the oxide is a metal oxide such as titanium oxide, zinc oxide, tin oxide, zirconium oxide and aluminum oxide. These metal oxides can be subjected to surface treatment from the standpoint of dispersibility in a coating liquid and of electrical properties of the electrophotographic photosensitive member. As the metal oxide, oxidatively treated zinc oxide is particularly preferable from the standpoint of electrical properties. Moreover, two kinds or more of the metal oxide particles according to the present invention such as the metal oxide particles of different kinds of metal oxides and the metal oxides each being subjected to a different kind of surface treatment or each having a different specific surface area can be mixed and used.

(β) is a benzophenone compound represented by the following formula (1).

(1)

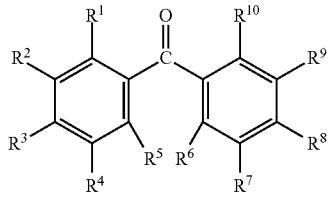

wherein $R^1$ to $R^{10}$ each independently represent a hydrogen atom, a hydroxy group, a halogen atom, an alkyl group, an alkoxy group or an amino group, provided that at least one of $R^1$ to $R^{10}$ is a hydroxy group.

The electrical properties in repetitive use are stabilized and the ghost phenomenon is suppressed to suppress the occurrence of image defects in output images by the (β) being contained in the undercoat layer together with the metal oxide particle.

Specific examples of the (β) (benzophenone compound represented by formula (1)) are shown below, but the present invention is not limited to these examples.

(1-1)

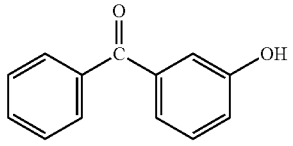

-continued (1-2)

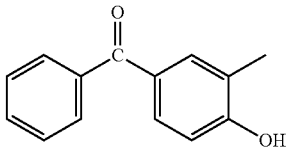

(1-3)

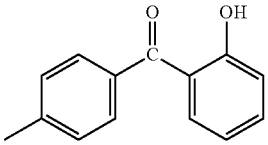

(1-4)

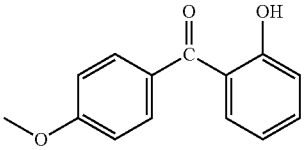

(1-5)

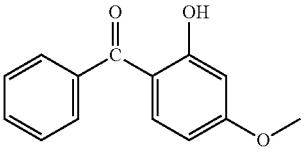

(1-6)

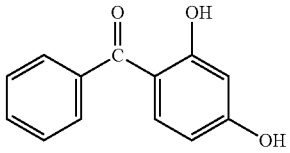

(1-7)

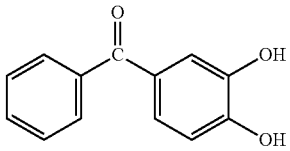

(1-8)

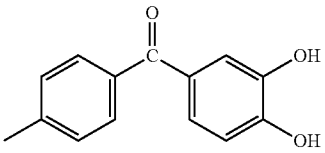

(1-9)

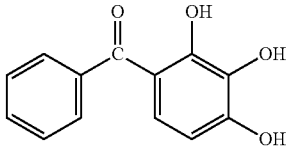

(1-10)

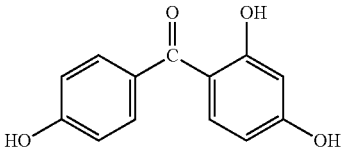

(1-11)

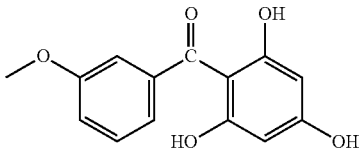

-continued (1-12)

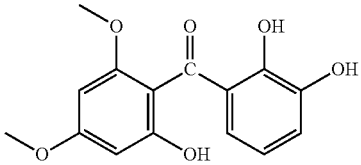

(1-13)

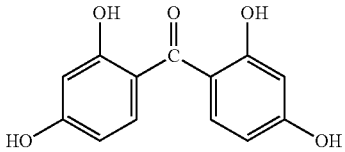

(1-14)

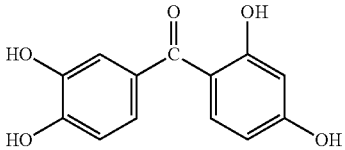

(1-15)

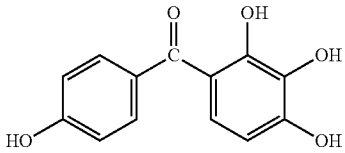

(1-16)

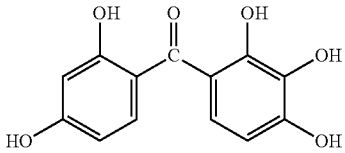

(1-17)

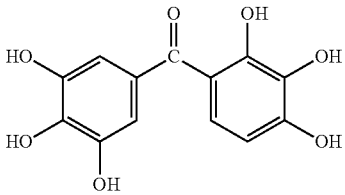

Among the compounds, the benzophenone compounds in which at least 3 of $R^1$ to $R^{10}$ in the formula (1) are hydroxy groups are preferable from the standpoint of the interaction with the metal oxide particle. Moreover, the benzophenone compounds in which 2 adjacent groups of $R^6$ to $R^{10}$ in the formula (1) are hydroxy groups are preferable from the standpoint of the interaction with the metal oxide particle.

The amount of (β) in the undercoat layer can be 0.1% by mass or more and 4.0% by mass or less relative to the metal oxide particle in the undercoat layer. The content of less than 0.1% by mass is not preferable because the interaction with the metal oxide particle is not sufficient, and the content of exceeding 4.0% by mass is not preferable because the stability of the coating liquid for an undercoat layer is lowered.

(γ) is a compound represented by the following formula (2).

(2)

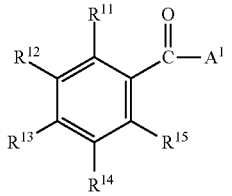

wherein $R^{11}$ to $R^{15}$ each independently represent a hydrogen atom, a hydroxy group, a halogen atom, an alkyl group, an alkoxy group or an amino group and $A^1$ represents an alkenyl group having 2 or more and 4 or less carbon atoms.

The electrical properties in repetitive use are stabilized even in the case where the electrophotographic photosensitive member absorbs moisture under a high-temperature and high-humidity environment by the (γ) being contained in the undercoat layer together with (α) the metal oxide particle and the (β). The mechanism by which the effect is obtained is not clear; however, the present inventors infer that the (γ) directly interacts with the metal oxide particle or enhances the interaction of the (β) and the metal oxide particle. It is inferred that, for example, the (γ) captures a substance that inhibits the coordination of the (β) to the metal oxide particle to make the coordination of the (β) to the metal oxide easy and, as a result, the electrical properties become more stable against the environmental variation due to moisture absorption.

Specific examples of (γ) (compound represented by formula (2)) are shown below, but the present invention is not limited to these examples.

(2-1)

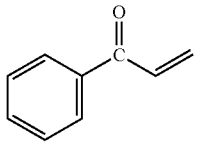

(2-2)

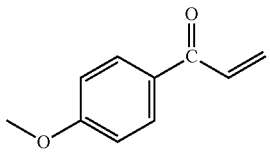

(2-3)

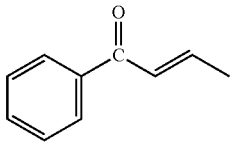

(2-4)

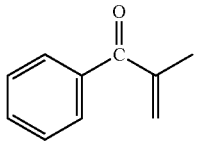

-continued (2-5)

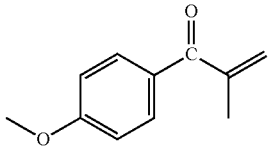

(2-6)

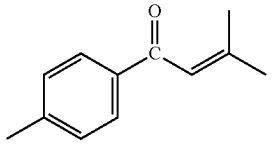

(2-7)

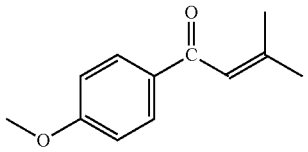

Among the compounds, the compound represented by formula (2-3) in which $A^1$ in the formula (2) is a 1-propenyl group is particularly preferable.

The amount of (γ) in the undercoat layer can be 1.0% by mass or more and 15% by mass or less relative to the amount of the (β) in the undercoat layer. The amount of less than 1.0% by mass is not preferable because the effect is insufficient and the amount of 15% by mass or more is not preferable because the stability of the coating liquid for an undercoat layer is lowered.

In addition, it can be confirmed by head space gas chromatography/mass analysis or the like that the undercoat layer contains a compound represented by the (γ).

Next, the electrophotographic photosensitive member included in the electrophotographic apparatus according to the present invention will be described. The electrophotographic photosensitive member according to the present invention includes, for example, an undercoat layer between a support and a photosensitive layer as illustrated in FIG. 1. In FIG. 1, reference numeral 101 denotes the support, reference numeral 102 denotes the undercoat layer and reference numeral 103 denotes the photosensitive layer.

The photosensitive layer may have any configuration of a single layer type photosensitive layer that contains a charge generating substance and a charge transporting substance in a single layer and a function separation type (lamination type) photosensitive layer that separates functions into a charge generating layer that contains a charge generating substance and a charge transporting layer that contains a charge transporting substance. The function separation type (lamination type) is preferable from the standpoint of electrophotographic properties and the function separation type (lamination type) obtained by laminating the charge generating layer and the charge transporting layer in this order from the support side is more preferable. Moreover, a protective layer may further be provided on the photosensitive layer.

[Support]

The support can be a support having electrical conductivity (electrically conductive support). As the support, a support formed with a metal or alloy such as aluminum, nickel, copper, gold or iron can be used. Examples of the support include: a support formed with a thin film of a metal such as aluminum, silver or gold on an insulating support such as a polyester resin, a polycarbonate resin, a polyimide resin or glass, or a support formed with a thin film of a conductive material such as indium oxide or tin oxide.

The surface of the support may be subjected to: electrochemical treatment such as anodic oxidation; wet honing treatment; blast treatment; or cutting treatment in order to improve the electrical properties or suppress interference fringes.

An electrically conductive layer may be provided between the support and the undercoat layer for the purpose of suppressing interference fringes that occur due to interference of laser light used for image exposure, coating the scratches on the support, or other purposes.

The electrically conductive layer can be formed by drying a coating film obtained through coating with a coating liquid for an electrically conductive layer, which is obtained by subjecting, for example, carbon black, an electrically conductive pigment, a resistance-adjusting pigment or the like to dispersion treatment together with a binder resin. Moreover, a compound that is cured and polymerized by heating, ultraviolet ray irradiation, radiation irradiation or the like may be added to the coating liquid for an electrically conductive layer.

The film thickness of the electrically conductive layer is preferably 0.2 μm or more and 40 μm or less, more preferably 1 μm or more and 35 μm or less and still more preferably 5 μm or more and 30 μm or less.

[Undercoat Layer]

The undercoat layer is provided between the support and the photosensitive layer (charge generating layer).

As a process for forming an undercoat layer, a coating liquid for an undercoat layer containing (α), (β), (γ) and a binder resin is first prepared to form a coating film of the coating liquid for an undercoat layer. The undercoat layer can be formed through drying the coating film by heating. Moreover, the coating liquid for an undercoat layer may be a coating liquid for an undercoat layer obtained by adding a liquid containing a binder resin dissolved therein to a dispersion liquid obtained by subjecting (α), (β) and a compound represented by (γ) to dispersion treatment together with a solvent and then further subjecting the resultant mixture to dispersion treatment. Examples of the dispersion method include methods using a homogenizer, an ultrasonic disperser, a ball mill, a sand mill, a roll mill, a vibrating mill, an attritor and a liquid collision type high speed disperser.

Examples of the binder resin contained in the undercoat layer include acrylic resins, allyl resins, alkyd resins, ethyl cellulose resins, ethylene-acrylic copolymers, epoxy resins, casein resins, silicone resins, gelatin resins, phenol resins, butyral resins, polyacrylate resins, polyacetal resins, polyamide-imide resins, polyamide resins, polyallyl ether resins, polyimide resins, polyurethane resins, polyester resins, polyethylene resins, polycarbonate resins, polystyrene resins, polysulfone resins, polyvinyl alcohol resins, polybutadiene resins and polypropylene resins. Among the binder resins, polyurethane resins are preferable.

Examples of the solvent for use in the coating liquid for an undercoat layer include organic solvents such as alcohol-based solvents, sulfoxide-based solvents, ketone-based solvents, ether-based solvents, ester-based solvents, halogenated aliphatic hydrocarbon-based solvents and aromatic compounds.

The undercoat layer may further contain an organic resin particle or a levelling agent.

The film thickness of the undercoat layer is preferably 0.5 μm or more and 50 μm or less, more preferably 1 μm or more and 40 μm or less.

Furthermore, a process for producing an electrophotographic photosensitive member including: a support; a photosensitive layer; and an undercoat layer between the support and the photosensitive layer includes forming a coating film through coating with a coating liquid for an undercoat layer and drying the coating film, thereby forming the undercoat layer, in which the coating liquid for an undercoat layer includes: (α) a metal oxide particle; (β) a benzophenone compound represented by formula (1); (γ) a compound represented by formula (2); and (δ) water.

The water content of the coating liquid for an undercoat layer is 2% by mass or more and 10% by mass or less relative to the total mass of the coating liquid for an undercoat layer.

[Photosensitive Layer]

The photosensitive layer (charge generating layer, charge transporting layer) is formed on the undercoat layer.

As the charge generating substance for use in the present invention include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinoneimine dyes and styryl dyes.

These charge generating substances may be used alone or in combination of two or more. Among the charge generating substances, phthalocyanine pigments and azo pigments are preferable from the standpoint of sensitivity and phthalocyanine pigments are more preferable.

Among the phthalocyanine pigments, particularly, oxytitanium phthalocyanine, chloro gallium phthalocyanine or hydroxy gallium phthalocyanine exhibit an excellent charge generating efficiency. Furthermore, among hydroxy gallium phthalocyanines, hydroxy gallium phthalocyanine crystals of a crystal form having intense peaks at a Bragg angle 2θ of 7.4°±0.3° and of 28.20±0.3° in CuKα characteristic X-ray diffraction are more preferable from the standpoint of sensitivity.

In the case of a lamination type photosensitive layer, examples of the binder resin for use in the charge generating layer include acrylic resins, allyl resins, alkyd resins, epoxy resins, diallyl phthalate resins, styrene-butadiene copolymers, butyral resins, benzal resins, polyacrylate resins, polyacetal resins, polyamide-imide resins, polyamide resins, polyallyl ether resins, polyarylate resins, polyimide resins, polyurethane resins, polyester resins, polyethylene resins, polycarbonate resins, polystyrene resins, polysulfone resins, polyvinyl acetal resins, polybutadiene resins, polypropylene resins, methacrylic resins, urea resins, vinyl chloride-vinyl acetate copolymers, vinyl acetate resins and vinyl chloride resins.

Among these binder resins, butyral resins are particularly preferable. These resins can be used alone or in combination of two or more as a single polymer, a mixed polymer or a copolymer.

The charge generating layer can be formed by drying a coating film obtained through coating with a coating liquid for a charge generation layer, which is obtained by subjecting the charge generating substance to dispersion treatment together with the binder resin and the solvent. The charge generating layer may be a vapor deposited film of a charge generating substance.

The ratio of the charge generating substance to the binder resin is more preferably 0.3 parts by mass or more and 10 parts by mass or less of the charge generating substance relative to 1 part by mass of the binder resin.

Examples of the solvent for use in the coating liquid for a charge generating layer include alcohol-based solvents, sulfoxide-based solvents, ketone-based solvents, ether-based solvents, ester-based solvents, halogenated aliphatic hydrocarbon-based solvents and aromatic compounds.

The film thickness of the charge generating layer is preferably 0.01 μm or more and 5 μm or less, more preferably 0.1 μm or more and 2 μm or less. Moreover, various kinds of sensitizers, antioxidants, ultraviolet absorbers and plasticizers can be added to the charge generating layer as necessary.

In the electrophotographic photosensitive member including a lamination type photosensitive layer, a charge transporting layer is formed on the charge generating layer.

Examples of the charge transporting substance for use in the present invention include triarylamine compounds, hydrazone compounds, styryl compounds, stilbene compounds and butadiene compounds. These charge transporting substances may be used alone or in combination of two or more. Among these charge transporting substances, triarylamine compounds are preferable from the standpoint of charge mobility.

In the case of a lamination type photosensitive layer, examples of the binder resin for use in the charge transporting layer include acrylic resins, acrylonitrile resins, allyl resins, alkyd resins, epoxy resins, silicone resins, phenol resins, phenoxy resins, polyacrylamide resins, polyamide-imide resins, polyamide resins, polyallyl ether resins, polyarylate resins, polyimide resins, polyurethane resins, polyester resins, polyethylene resins, polycarbonate resins, polysulfone resins, polyphenylene oxide resins, polybutadiene resins, polypropylene resins and methacrylic resins.

Among these binder resins, polyarylate resins and polycarbonate resins are preferable. These binder resins can be used alone or in combination of two or more as a single polymer, a mixed polymer, or a copolymer.

The charge transporting layer can be formed by drying a coating film obtained through coating with a coating liquid for a charge transporting layer, which is obtained by dissolving the charge transporting substance and the binder resin in a solvent. The ratio of the charge transporting substance to the binder resin in the charge transporting layer can be 0.3 parts by mass or more and 10 parts by mass or less of the charge transporting substance relative to 1 part by mass of the binder resin. Moreover, the temperature for drying is preferably 60° C. or higher and 150° C. or lower, more preferably 80° C. or higher and 120° C. or lower from the standpoint of suppression of cracks in the charge transporting layer. Moreover, the time for drying can be 10 minutes or more and 60 minutes or less.

Examples of the solvent for use in the coating liquid for a charge transporting layer include alcohol-based solvents, sulfoxide-based solvents, ketone-based solvents, ether-based solvents, ester-based solvents, halogenated aliphatic hydrocarbon-based solvents and aromatic hydrocarbon-based solvents.

In the case where the charge transporting layer of the electrophotographic photosensitive member is a single layer, the film thickness of the charge transporting layer is preferably 5 μm or more and 40 μm or less, more preferably 8 μm or more and 30 μm or less. In the case where the charge transporting layer is made to be a lamination configuration (for example, first charge transporting layer, second charge transporting layer), the film thickness of the charge transporting layer on the support side can be 5 μm or more and 30 μm or less, and the film thickness of the charge transporting layer on the surface side can be 1 μm or more and 10 μm or less.

Moreover, antioxidants, ultraviolet absorbers and plasticizers can be added to the charge transporting layer as necessary.

Moreover, in the present invention, a protective layer may be provided on the photosensitive layer for the purpose of protecting the photosensitive layer, improving wear resistance or cleaning properties, or other purposes.

The protective layer can be formed by drying a coating film obtained through coating with a coating liquid for a protective layer, which is obtained by dissolving the binder resin in an organic solvent.

Examples of the resin for use in the protective layer include polyvinyl butyral resins, polyester resins, polycarbonate resins, polyamide resins, polyimide resins, polyarylate resins, polyurethane resins, styrene-butadiene copolymers, styrene-acrylic copolymers and styrene acrylonitrile copolymers.

Moreover, the protective layer may be formed by curing a monomer material having charge transporting ability or a polymeric type charge transporting substance through various kinds of crosslinking reactions in order to allow the protective layer to have charge transporting ability. Preferably, the layer is formed by polymerizing or crosslinking a charge transporting compound having a chain-polymerizable functional group to cure the charge transporting compound. Examples of the chain-polymerizable functional group include an acrylic group, a methacrylic group, an alkoxysilyl group and an epoxy group. Examples of the reaction for curing include radical polymerization, ionic polymerization, thermal polymerization, photopolymerization, radiation polymerization (electron beam polymerization), a plasma CVD method and a photo CVD method.

The film thickness of the protective layer is preferably 0.5 μm or more and 10 μm or less, more preferably 1 μm or more and 7 μm or less. Moreover, an electrically conductive particle or the like can be added to the protective layer as necessary.

Moreover, the outermost surface layer (charge transporting layer or protective layer) of the electrophotographic photosensitive member may contain a lubricant such as a silicone oil, wax, a fluorine atom-containing resin particle such as a polytetrafluoroethylene particle, a silica particle, an aluminum particle or boron nitride.

When coating is conducted with the coating liquid for each layer, coating methods such as, for example, a dip coating method, a spray coating method, a spinner coating method, a roller coating method, a Meyer bar coating method and a blade coating method can be used.

[Electrophotographic Apparatus]

Next, the electrophotographic apparatus will be described. The electrophotographic apparatus according to the present invention includes at least: an electrophotographic photosensitive member; a charging roller disposed so as to abut on the electrophotographic photosensitive member; and a charging unit charging the electrophotographic photosensitive member by applying only a direct-current voltage.

A charging roller including a cored bar, an elastic layer formed on the cored bar, and a resistive layer (surface layer) formed on the elastic layer is generally used. The resistive layer is provided to adjust the resistance of the whole charging roller.

The elastic layer can be formed by, for example, dispersing an electrically conductive particle such as a metal oxide (such as $TiO_2$) or carbon black in an elastic body such as butadiene-based rubber, hydrin rubber, EPDM, or urethane rubber.

The resistive layer (surface layer) can be formed by, for example, dispersing an electrically conductive particle such as carbon black or tin oxide in a binder component such as: rubber such as vinylidene fluoride-based rubber, tetrafluoroethylene-propylene rubber, epichlorohydrin rubber, acrylic rubber or urethane rubber; an acrylic-based resin; or a fluorinated resin.

Moreover, a cleaning member for a charging roller may be provided in order to remove soil (such as toner, external additive as component of toner and shavings of electrophotographic photosensitive member) adhered to the surface of the charging roller.

The cleaning member for a charging roller may be rotated to follow the rotation of the charging roller or may be rotated using a rotary drive system.

The cleaning member for a charging roller may be connected to ground (earthed) or voltage may be applied to the cleaning member.

Examples of the shape of the cleaning member for a charging roller include a brush shape (cleaning brush), a roller shape (cleaning roller) and a blade shape (cleaning blade).

Figure 2:
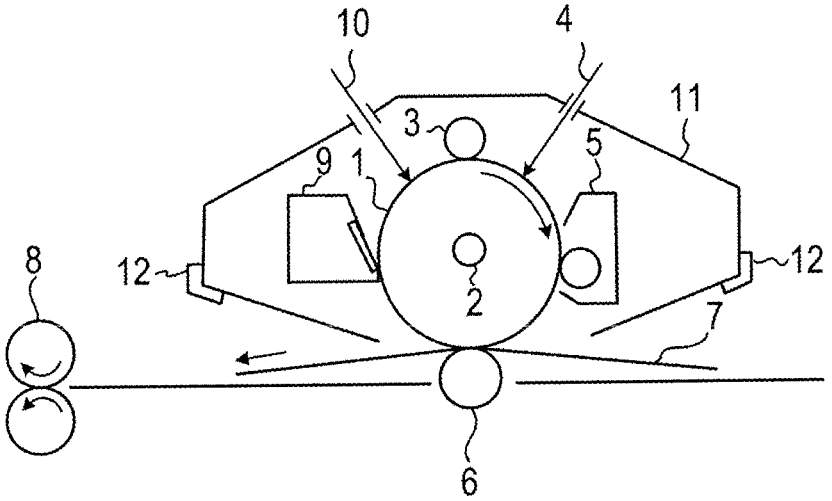
FIG. 2 is a diagram illustrating an example of an electrophotographic apparatus according to the present invention.

FIG. 2 illustrates an example of a schematic configuration of an electrophotographic apparatus according to the present invention provided with a process cartridge including an electrophotographic photosensitive member.

In FIG. 2, the electrophotographic photosensitive member 1 in a cylindrical shape (drum shape) is rotationally driven around an axis 2 in an arrow direction with a predetermined peripheral velocity (process speed). The surface (circumferential face) of the electrophotographic photosensitive member 1 is positively or negatively charged by the charging unit described above and a charging roller 3 in the rotation process. Subsequently, the surface of the electrophotographic photosensitive member 1 is irradiated with exposing light (image-exposing light) 4 output from an exposing unit (image-exposing unit) (not illustrated in figure). The exposing light 4 is subjected to intensity modulation corresponding to time sequential electric digital image signals for target image information. Examples of the exposing unit include slit exposure and exposure by laser beam scanning. In this way, an electrostatic latent image corresponding to the target image information is formed on the surface of the electrophotographic photosensitive member 1.

Subsequently, the electrostatic latent image formed on the surface of the electrophotographic photosensitive member 1 is developed (normal development or reversal development) with a toner accommodated in a developing unit 5 to form a toner image. The toner image formed on the surface of the electrophotographic photosensitive member 1 is transferred to a transfer material 7 with a transferring unit 6. In the case where the transfer material 7 is paper, the paper is taken out from a paper feeding section (not illustrated in figure) synchronously with the rotation of the electrophotographic photosensitive member 1 and fed between the electrophotographic photosensitive member 1 and the transferring unit 6. Moreover, a bias voltage having a reverse polarity to a charge held by the toner is applied to the transferring unit 6 from a bias power source (not illustrated in figure). Furthermore, the transferring unit may be an intermediate transfer type transferring unit including a primary transferring member, an intermediate transfer member and a secondary transferring member.

The transfer material 7 to which the toner image has been transferred is separated from the surface of the electrophotographic photosensitive member 1, conveyed to a fixing unit 8 where the toner image is subjected to fixing treatment, and the toner image is printed out as an image-formed product (print, copy) outside the electrophotographic apparatus.

The surface of the electrophotographic photosensitive member 1 after the toner image is transferred is cleaned with a cleaning unit 9 and adhered materials such as a toner left after transfer are removed. The toner left after transfer can be collected with the developing unit. Furthermore, the surface of the electrophotographic photosensitive member 1 is subjected to treatment for removal of electricity by irradiation with pre-exposing light 10 from a pre-exposing unit (not illustrated in figure) and thereafter is used for image formation repeatedly as necessary.

A plurality of constituents selected from the electrophotographic photosensitive member 1, the charging roller 3, the developing unit 5, the transferring unit 6, the cleaning unit 9 and the like may be accommodated in a container to produce a process cartridge. Moreover, a configuration in which a process cartridge is detachably attachable to an electrophotographic apparatus main body may be used. For example, the electrophotographic photosensitive member 1 and at least one unit selected from the group consisting of the charging roller 3, the developing unit 5, transferring unit 6 and the cleaning unit 9 are integrally supported to make a cartridge. The cartridge can be used as the process cartridge 11 that is detachably attachable to the electrophotographic apparatus main body using a guiding unit 12 such as a rail of the electrophotographic apparatus main body.

Synthesis Example

A representative synthesis example of (β) contained in an undercoat layer of an electrophotographic photosensitive member included in an electrophotographic apparatus according to the present invention is shown below.

Synthesis was conducted through reaction represented by the following reaction formula (1).

A nitrogen introducing pipe, a thermometer for measuring internal temperature and the like were attached to a three-necked flask. With a mechanical stirrer, 14.0 parts of benzoyl chloride, 20.0 parts of aluminum trichloride and 100 parts of dichloromethane were stirred while conducting nitrogen purging in the flask. Subsequently, a pyrogallol/dichloromethane (12.6 parts/50 parts) solution was slowly dropped and the resultant mixture is further stirred and reacted for 6 hours at room temperature while conducting nitrogen purging.

Subsequently, the reaction liquid was dropped into ice water containing diluted hydrochloric acid, an organic layer and an aqueous layer were then separated with a separatory funnel and, further, the obtained organic layer was washed with water. The organic layer was taken out and dehydrated with anhydrous magnesium sulfate. After the anhydrous magnesium sulfate was removed, the organic layer was condensed to obtain a crude product of a target compound. The obtained crude product was purified by column chromatography using a silica gel to obtain a compound represented by formula (1-9) being the target compound. The yield was 16.1 parts and the percent yield is 69.9%.

Reaction Formula (1)

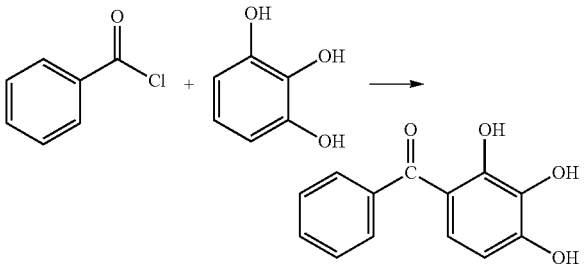

Formula (1-9)

Electrophotographic photosensitive members were produced and evaluated as shown in Examples below using the compound thus synthesized.

EXAMPLES

Hereinafter, the present invention will be described in more detail giving specific examples. However, the present invention is not limited to these examples. It is to be noted that "parts" in Examples mean "parts by mass".

Production Examples of Electrophotographic Photosensitive Member

Production Example D1

Surface Treatment of Zinc Oxide Particle

With 500 parts of toluene, 100 parts of a zinc oxide particle (specific surface area: 19 $m^2/g$, powder resistance: $4.7\times10^6$ Ω·cm) was stirred and mixed, 0.8 parts of a silane coupling agent (compound name: N-2-(aminoethyl)-3-aminopropyl methyl dimethoxy silane, trade name: KBM602, manufactured by Shin-Etsu Chemical Co., Ltd.) was then added thereto and the resultant mixture was stirred for 6 hours. Thereafter, toluene was distilled away under reduced pressure and the residue was dried by heating at 130° C. for 6 hours to obtain a surface-treated zinc oxide particle.

Subsequently, 80 parts of the surface-treated zinc oxide particle, 0.8 parts of the compound represented by formula (1-9), 1.6 parts of a methyl ethyl ketone solution containing 1% of the compound represented by formula (2-3) and 15 parts of a polyvinyl butyral resin (trade name: BM-1, manufactured by Sekisui Chemical Co., Ltd.) as a polyol resin were mixed with a solution obtained by dissolving 15 parts of a blocked isocyanate (trade name: Sumidur 3175, manufactured by Sumitomo Bayer Urethane Co., Ltd.) as a curing agent in a mixed liquid of 72 parts of methyl ethyl ketone and 72 parts of 1-butanol.

The resultant mixed liquid was dispersed with a sand mill apparatus with a glass bead having a diameter of 0.8 mm under an atmosphere of 23±3° C. for 3 hours. After the dispersion, 0.01 parts of a silicone oil (trade name: SH 28 PA, manufactured by Dow Corning Toray Co., Ltd.) and 5.6 parts of a crosslinked polymethylmethacrylate (PMMA) particle (trade name: TECHPOLYMER SSX-103, manufactured by Sekisui Plastics Co., Ltd.) were added to the dispersion liquid and the resultant mixture was stirred to obtain a coating liquid for an undercoat layer.

An aluminum cylinder having a diameter of 30 mm and a length of 357.5 mm, which was used as a support (electrically conductive support), was dip-coated with the coating liquid for an undercoat layer and the coating liquid on the aluminum cylinder was dried at 160° C. for 40 minutes to form an undercoat layer having a film thickness of 30 μm.

Subsequently, 20 parts of a hydroxy gallium phthalocyanine crystal (charge generating substance) of a crystal form having intense peaks at a Bragg angle 20±0.2° of 7.4° and of 28.2° in CuKα characteristic X-ray diffraction, 0.2 parts of a calixarene compound represented by the following structural formula (A), 10 parts of a polyvinyl butyral resin (trade name: S-LEC BX-1, manufactured by Sekisui Chemical Co., Ltd.) and 600 parts of cyclohexanone were placed in a sand mill with a glass bead having a diameter of 1 mm and were subjected to dispersion treatment for 4 hours and thereafter, 600 parts of ethyl acetate was added thereto to prepare a coating liquid for a charge generating layer.

The undercoat layer was dip-coated with the coating liquid for a charge generating layer and the obtained coating film was dried at 80° C. for 15 minutes to form a charge generating layer having a film thickness of 0.21 μm.

(A)

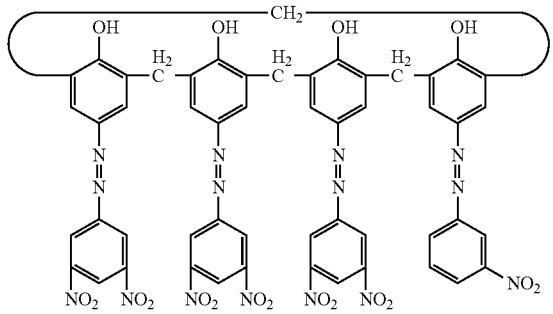

Subsequently, 60 parts of the compound represented by the following structural formula (B) (charge transporting substance), 30 parts of the compound represented by the following structural formula (C) (charge transporting substance), 10 parts of the compound represented by the following structural formula (D), 100 parts of a polycarbonate resin (bisphenol Z type polycarbonate, trade name: Iupilon Z400, manufactured by Mitsubishi Engineering-Plastics Corporation) and 0.02 parts of a polycarbonate represented by the following structural formula (E) (viscosity average molecular weight Mv: 20000) were dissolved in a mixed solvent of 600 parts of o-xylene and 200 parts of dimethoxy methane to prepare a coating liquid for a charge transporting layer. The charge generating layer was dip-coated with the coating liquid for a charge transporting layer to form a coating film and the obtained coating film was dried at 100° C. for 30 minutes to form a charge transporting layer having a film thickness of 18 μm.

(B)

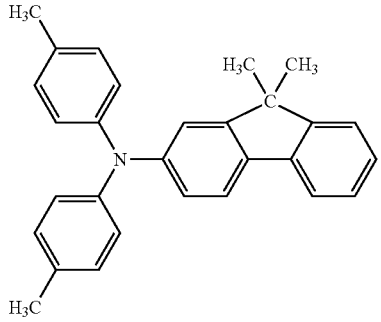

-continued (C)

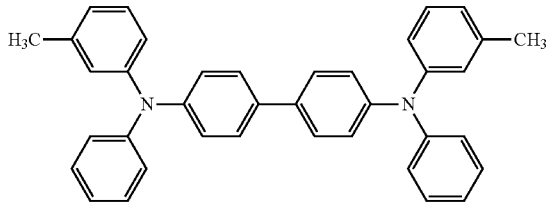

(D)

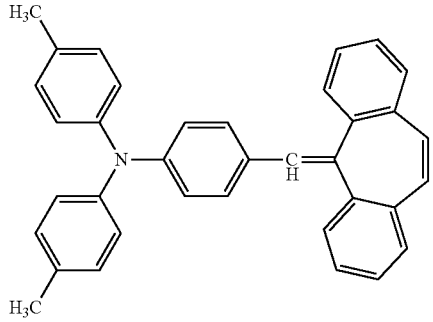

(E)

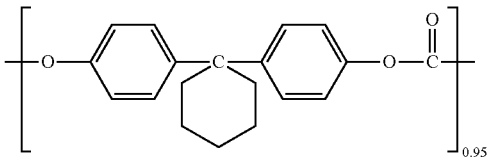

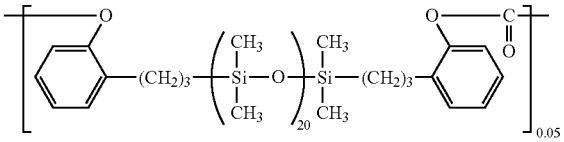

Subsequently, the charge transporting layer was coated with a coating liquid for a protective layer following the procedures below.

In a mixed solvent of 45 parts of 1,1,2,2,3,3,4-heptafluorocyclopentane (trade name: ZEORORA H, manufactured by Zeon Corporation) and 45 parts of 1-propanol, 1.5 parts of a fluorine atom-containing resin (trade name: GF-300, manufactured by Toagosei Co., Ltd) was dissolved. Thereafter, a mixed liquid obtained by adding 30 parts of a tetrafluoroethylene resin powder (trade name: Lubron L-2, manufactured by Daikin Industries, Ltd.) to the solution was passed through a high-pressure disperser (trade name: Microfluidizer M-110EH, manufactured by Microfluidizics Corp.) to obtain a dispersion liquid. Thereafter, 70 parts of a positive hole transporting compound represented by the following formula (F), (F)

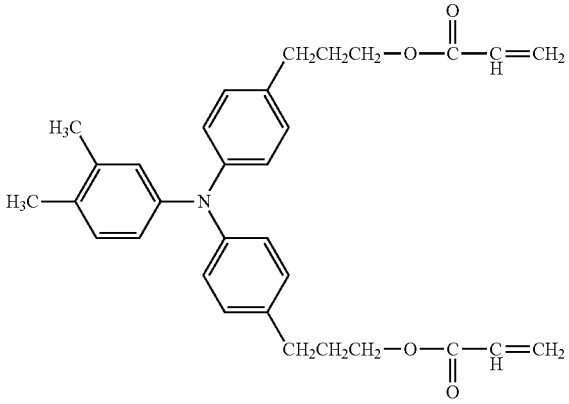

30 parts of 1,1,2,2,3,3,4-heptafluorocyclopentane and 30 parts of 1-propanol were added to the dispersion liquid, and the resultant mixture was filtered with a polyflon filter (trade name: PF-040, manufactured by Advantec Toyo Kaisha, Ltd.) to prepare a coating liquid for a protective layer.

The charge transporting layer was dip-coated with the coating liquid for a protective layer and the obtained coating film was dried at 50° C. for 5 minutes. After drying, the coating film was irradiated with an electron beam under the conditions of an acceleration voltage of 60 kV and an absorbed dose of 8000 Gy for 1.6 seconds in a nitrogen atmosphere. Thereafter, the coating film was subjected to heat treatment for 1 minute in a nitrogen atmosphere under the condition that the temperature of the coating film reached 130° C. In addition, the oxygen concentration from the irradiation with the electron beam to the heat treatment for 1 minute was 20 ppm. Subsequently, the coating film was subjected to heat treatment for 1 hour in the atmosphere under the condition that the coating film reached 110° C. to form a protective layer having a film thickness of 5 μm. In this way, an electrophotographic photosensitive member D1 including the undercoat layer, the charge generating layer, the charge transporting layer and the protective layer on the support was produced.

Production Examples D2 to D4

Electrophotographic photosensitive members D2 to D4 were produced in the same manner as in Production Example D1 except that the amount of the polyvinyl butyral resin (trade name: BM-1, manufactured by Sekisui Chemical Co., Ltd.) and the amount of blocked isocyanate (trade name: Sumidur 3175, manufactured by Sumitomo Bayer Urethane Co., Ltd.) added to the coating liquid for an undercoat layer in Production Example D1 were changed as shown in Table 1.

Production Examples D5 to D7

Electrophotographic photosensitive members D5 to D7 were produced in the same manner as in Production Example D1 except that the solvent used in the coating liquid for an undercoat layer and the amount thereof in Production Example D1 were changed as shown in Table 1.

Production Example D8

(Surface Treatment of Titanium Oxide Particle)

With 500 parts of toluene, 100 parts of a titanium oxide particle (trade name: JR-301, manufactured by Tayca Corporation) was stirred and mixed, 0.8 parts of a silane coupling agent (compound name: N-2-(aminoethyl)-3-aminopropyl methyl dimethoxy silane, trade name: KBM602, manufactured by Shin-Etsu Chemical Co., Ltd.) was then added thereto and the resultant mixture was stirred for 6 hours. Thereafter, toluene was distilled away under reduced pressure and the residue was dried by heating at 130° C. for 6 hours to obtain a surface-treated titanium oxide particle.

Subsequently, 80 parts of the surface-treated zinc oxide particle, 4 parts of the surface-treated titanium oxide particle, 0.8 parts of the compound represented by formula (1-9), 1.6 parts of a methyl ethyl ketone solution containing 1% of the compound represented by formula (2-3) and 15 parts of a polyvinyl butyral resin (trade name: BM-1, manufactured by Sekisui Chemical Co., Ltd.) were mixed with a solution obtained by dissolving 15 parts of a blocked isocyanate (trade name: Sumidur 3175, manufactured by Sumitomo Bayer Urethane Co., Ltd.) in a mixed liquid of 72 parts of methyl ethyl ketone and 72 parts of 1-butanol.

The resultant mixed liquid was dispersed with a sand mill apparatus with a glass bead having a diameter of 0.8 mm under an atmosphere of 23±3° C. for 3 hours. After the dispersion, 0.01 parts of a silicone oil (trade name: SH 28 PA, manufactured by Dow Corning Toray Co., Ltd.) and 5.6 parts of a crosslinked polymethylmethacrylate (PMMA) particle (trade name: TECHPOLYMER SSX-103, manufactured by Sekisui Plastics Co., Ltd.) were added to the dispersion liquid and the resultant mixture was stirred to obtain a coating liquid for an undercoat layer.

An aluminum cylinder having a diameter of 30 mm and a length of 357.5 mm, which was used as a support, was dip-coated with the coating liquid for an undercoat layer and the coating liquid on the aluminum cylinder was dried at 160° C. for 40 minutes to form an undercoat layer having a film thickness of 30 μm.

An electrophotographic photosensitive member D8 was produced in the same manner as in Production Example D1 in terms of subsequent procedures.

Production Example D9

With a solution obtained by dissolving 15 parts of a blocked isocyanate (trade name: Sumidur 3175, manufactured by Sumitomo Bayer Urethane Co., Ltd.) in a mixed liquid of 72 parts of methyl ethyl ketone and 72 parts of 1-butanol, 80 parts of the surface-treated zinc oxide particle, 4 parts of a titanium oxide particle (trade name: JR-301, manufactured by Tayca Corporation), 0.8 parts of the compound represented by formula (1-9), 1.6 parts of a methyl ethyl ketone solution containing 1% of the compound represented by formula (2-3) and 15 parts of a polyvinyl butyral resin (trade name: BM-1, manufactured by Sekisui Chemical Co., Ltd.) were mixed.

The resultant mixed liquid was dispersed with a sand mill apparatus with a glass bead having a diameter of 0.8 mm under an atmosphere of 23±3° C. for 3 hours. After the dispersion, 0.01 parts of a silicone oil (trade name: SH 28 PA, manufactured by Dow Corning Toray Co., Ltd.) and 5.6 parts of a crosslinked polymethylmethacrylate (PMMA) particle (trade name: TECHPOLYMER SSX-103, manufactured by Sekisui Plastics Co., Ltd.) were added to the dispersion liquid and the resultant mixture was stirred to obtain a coating liquid for an undercoat layer.

An aluminum cylinder having a diameter of 30 mm and a length of 357.5 mm, which was used as a support, was dip-coated with the coating liquid for an undercoat layer and the coating liquid on the aluminum cylinder was dried at 160° C. for 40 minutes to form an undercoat layer having a film thickness of 30 μm.

An electrophotographic photosensitive member D9 was produced in the same manner as in Production Example D1 in terms of subsequent procedures.

Production Example D10

An electrophotographic photosensitive member D10 was produced in the same manner as in Production Example D9 except that the titanium oxide particle (trade name: JR-301, manufactured by Tayca Corporation) in Production Example D9 was changed to a titanium oxide particle (trade name: CR-50, manufactured by Ishihara Sangyo Kaisha, Ltd.).

Production Example D11 to D27

Electrophotographic photosensitive members D11 to D27 were produced in the same manner as in Production Example D1 except that (β) and (γ) contained in the undercoat layer in Production Example D1 were changed as shown in Table 1.

Comparative Production Example d1

An electrophotographic photosensitive member d1 for comparison was produced in the same manner as in Production Example D1 except that the compound represented by formula (2-3) in Production Example D1 was changed to the compound represented by the following formula (G).

(G)

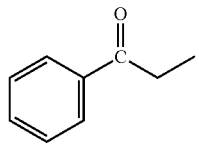

Comparative Production Example d2

An electrophotographic photosensitive member d2 for comparison was produced in the same manner as in Production Example D1 except that the compound represented by formula (2-3) in Production Example D1 was changed to the compound represented by the following formula (H).

(H)

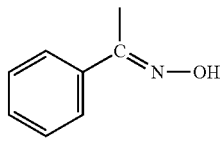

Comparative Production Example d3

An electrophotographic photosensitive member d3 for comparison was produced in the same manner as in Production Example D1 except that the compound represented by formula (1-9) in Production Example D1 was changed to the compound represented by the following formula (I).

(I)

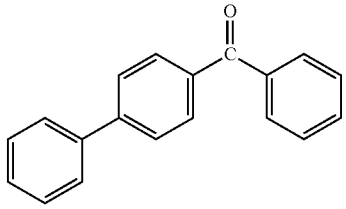

Example 1

(Evaluation of Electrophotographic Apparatus)

A modified machine of a copying machine, imageRUNNER ADVANCE C3330 manufactured by Canon Inc., was used as an electrophotographic apparatus for evaluation. The evaluation apparatus was set under an environment of a temperature of 23° C. and a humidity of 50% RH. Measurement of the surface potential of the electrophotographic photosensitive members was conducted in such a way that a developing cartridge was taken out from the evaluation apparatus and a potential measuring apparatus was inserted into the developing cartridge. The potential measuring apparatus was configured by disposing a potential measuring probe at a developing position of the developing cartridge, and the position of the potential measuring probe was determined to be the center in the bus line direction of the electrophotographic photosensitive member.

The electrophotographic photosensitive member D1 used for the measurement was left to stand under an environment of a temperature of 50° C. and a humidity of 95% RH for 3 days and further under an environment of a temperature of 23° C. and a humidity of 50% RH overnight and thereafter was set in the evaluation apparatus.

As a charging condition of the evaluation apparatus, the direct-current voltage applied to the charging roller was adjusted so that the initial dark part potential might be −700 V. As an exposing condition, the amount of laser light was adjusted so that the initial bright part potential (VLa) in exposing irradiation with 780 nm laser might be −200 V.

The developing cartridge was attached to the evaluation apparatus and continuous 200000-page repetitive use was carried out for the electrophotographic photosensitive member. The developing cartridge was left to stand for 5 minutes after the 200000-page repetitive use and then attached to the potential measuring apparatus, and the bright part potential (VLb) after the repetitive use was measured for each electrophotographic photosensitive member. In addition, the measurement of the potential was conducted for each electrophotographic photosensitive member under the same charging condition and exposing condition as initially set. The difference between the bright part potential after the repetitive use and the initial bright part potential was determined for each electrophotographic photosensitive member as the amount of variation in bright part potential ($\Delta VL=|VLb|-|VLa|$) (unit: V). The evaluation results are shown in Table 1.

Examples 2 to 27

Evaluation of variation in bright part potential was conducted in the same manner as in Example 1 except that the electrophotographic photosensitive members D2 to D27 were used in place of the electrophotographic photosensitive member D1 in Example 1. The results are shown in Table 1.

Comparative Examples 1 to 3

Evaluation of variation in bright part potential was conducted in the same manner as in Example 1 except that the electrophotographic photosensitive members for comparison d1 to d3 were used in place of the electrophotographic photosensitive member D1 in Example 1. The results are shown in Table 1.

TABLE 1

| | | | | | (β) Compound represented by formula (1) | | | (γ) Compound represented by formula (2) | | | |
|---|---|---|---|---|---|---|---|---|---|---|---|
| | Electrophotographic photosensitive member number | Solvent contained in coating liquid for under coat layer | Polyvinyl butyral resin/ blocked isocyanate (parts) | (α) | Structure | Amount added (parts) | Amount (% by mass) relative to (α) | Structure | Amount added (×1/100 parts) | Amount (% by mass) relative to (β) | ΔVL in 200000-page repetitive use |
| Example 1 | D1 | Methyl ethyl ketone 72 parts/ 1-butanol 72 parts | 15/15 | Surface-treated zinc oxide particle 80 parts | Formula (1-9) | 0.8 | 1.0 | Formula (2-3) | 1.6 | 2.0 | +12 |
| Example 2 | D2 | | 6/7.5 | | | 0.8 | 1.0 | | 1.6 | 2.0 | +13 |
| Example 3 | D3 | | 3/5 | | | 0.8 | 1.0 | | 1.6 | 2.0 | +12 |
| Example 4 | D4 | | 2/5.3 | | | 0.8 | 1.0 | | 1.6 | 2.0 | +14 |
| Example 5 | D5 | MEK 72 parts/ Cyclohexanone 72 parts | 15/15 | | | 0.8 | 1.0 | | 1.6 | 2.0 | +13 |
| Example 6 | D6 | MEK 144 parts | | | | 0.8 | 1.0 | | 1.6 | 2.0 | +15 |
| Example 7 | D7 | MEK 72 parts/ Cyclopentanone 72 parts | | | | 0.8 | 1.0 | | 1.6 | 2.0 | +13 |
| Example 8 | D8 | Methyl ethyl ketone 72 parts/ 1-butanol 72 parts | | Surface-treated zinc oxide particle 80 parts/ Surface-treated titanium oxide particle 4 parts | | 0.8 | 1.0 | | 1.6 | 2.0 | +13 |

TABLE 1-continued

| | Electrophotographic photosensitive member number | Solvent contained in coating liquid for under coat layer | Polyvinyl butyral resin/ blocked isocyanate (parts) | (α) | (β) Compound represented by formula (1) Structure | Amount added (parts) | Amount (% by mass) relative to (α) | (γ) Compound represented by formula (2) Structure | Amount added (×1/100 parts) | Amount (% by mass) relative to (β) | ΔVL in 200000-page repetitive use |
|---|---|---|---|---|---|---|---|---|---|---|---|
| Example 9 | D9 | | | Surface-treated zinc oxide particle 80 parts/ titanium oxide particle (JR-301) 4 parts | | 0.8 | 1.0 | | 1.6 | 2.0 | +15 |
| Example 10 | D10 | | | Surface-treated zinc oxide particle 80 parts/ titanium oxide particle (CR-50) 4 parts | | 0.8 | 1.0 | | 1.6 | 2.0 | +15 |
| Example 11 | D11 | | | Surface-treated zinc oxide particle 80 titanium oxide particle | | 0.08 | 0.1 | | 0.16 | 2.0 | +17 |
| Example 12 | D12 | | | | | 3.2 | 4.0 | | 6.4 | 2.0 | +18 |
| Example 13 | D13 | | | | | 0.04 | 0.05 | | 0.08 | 2.0 | +25 |
| Example 14 | D14 | | | | | 4.0 | 5.0 | | 8.0 | 2.0 | +23 |
| Example 15 | D15 | | | | | 0.8 | 1.0 | | 0.8 | 1.0 | +19 |
| Example 16 | D16 | | | | | 0.8 | 1.0 | | 12 | 15 | +17 |
| Example 17 | D17 | | | | | 0.8 | 1.0 | | 0.4 | 0.5 | +26 |
| Example 18 | D18 | | | | | 0.8 | 1.0 | | 16 | 20 | +22 |
| Example 19 | D19 | | | | Formula (1-15) | 0.4 | 0.5 | | 4.0 | 10 | +19 |
| Example 20 | D20 | | | | | 1.6 | 2.0 | | 8.0 | 5.0 | +18 |
| Example 21 | D21 | Methyl ethyl ketone 72 parts/ 1-butanol 72 parts | 15/15 | Surface-treated zinc oxide particle 80 titanium oxide particle | Formula (1-17) | 1.6 | 2.0 | Formula (2-3) | 8.0 | 5.0 | +19 |
| Example 22 | D22 | | | | Formula (1-11) | 2.4 | 3.0 | | 12 | 5.0 | +23 |
| Example 23 | D23 | | | | Formula (1-8) | 2.4 | 3.0 | | 12 | 5.0 | +20 |
| Example 24 | D24 | | | | Formula (1-2) | 2.4 | 3.0 | | 12 | 5.0 | +27 |
| Example 25 | D25 | | | | Formula (1-9) | 2.4 | 3.0 | Formula (2-1) | 12 | 5.0 | +26 |
| Example 26 | D26 | | | | | 2.4 | 3.0 | Formula (2-7) | 12 | 5.0 | +29 |
| Example 27 | D27 | | | | Formula (1-11) | 0.04 | 0.05 | | 0.8 | 20 | +34 |
| Comparative Example 1 | d1 | Methyl ethyl ketone 72 parts/ 1-butanol 72 parts | 15/15 | Surface-treated zinc oxide particle 80 parts | Formula (1-1) | 0.8 | 1.0 | Formula (G) | 1.6 | 2.0 | +45 |
| Comparative Example 2 | d2 | | | | | 0.8 | 1.0 | Formula (H) | 1.6 | 2.0 | +48 |
| Comparative Example 3 | d3 | | | | Formula (I) | 0.8 | 1.0 | Formula (2-3) | 1.6 | 2.0 | +61 |

Production Example D28

An electrophotographic photosensitive member D28 was produced in the same manner as in Production Example D1 except that the amount of methyl ethyl ketone and the amount of 1-butanol mixed in the coating liquid for an undercoat layer in Production Example D1 were each changed to 69.5 parts and 5 parts of water was further mixed.

Production Example D29

An electrophotographic photosensitive member D29 was produced in the same manner as in Production Example D1 except that the amount of methyl ethyl ketone and the amount of 1-butanol mixed in the coating liquid for an undercoat layer in Production Example D1 were each changed to 64.5 parts and 15 parts of water was further mixed.

Production Example D30

An electrophotographic photosensitive member D30 was produced in the same manner as in Production Example D1 except that the amount of methyl ethyl ketone and the amount of 1-butanol mixed in the coating liquid for an undercoat layer in Production Example D1 were each changed to 59 parts and 26 parts of water was further mixed.

Production Example D31

An electrophotographic photosensitive member D31 was produced in the same manner as in Production Example D1 except that heat and humidification treatment was further conducted under the condition of a temperature of 50° C. and a humidity of 95% RH for 336 hours to the surface-treated zinc oxide particle in Production Example D1.

Production Example D32

An electrophotographic photosensitive member D32 was produced in the same manner as in Production Example D1 except that after the surface-treated zinc oxide particle was produced in Production Example D1, the surface-treated zinc oxide particle was left to stand in an atmosphere of a temperature of 23° C. and a humidity of 50% RH for 1 year and then used.

Reference Production Example D33

An electrophotographic photosensitive member D33 was produced in the same manner as in Production Example D1 except that the amount of methyl ethyl ketone and the amount of 1-butanol mixed in the coating liquid for an undercoat layer in Production Example D1 were each changed to 71.5 parts and 1 part of water was further mixed.

Reference Production Example D34

An electrophotographic photosensitive member D34 was produced in the same manner as in Production Example D1 except that the amount of methyl ethyl ketone and the amount of 1-butanol mixed in the coating liquid for an undercoat layer in Production Example D1 were each changed to 71.9 parts and 0.2 parts of water was further mixed.

Example 28

Evaluation of variation in bright part potential was conducted in the same manner as in Example 1 except that the electrophotographic photosensitive member D28 was used in place of the electrophotographic photosensitive member D1 in Example 1. The result was ΔVL=+12 V.

Example 29

Evaluation of variation in bright part potential was conducted in the same manner as in Example 1 except that the electrophotographic photosensitive member D29 was used in place of the electrophotographic photosensitive member D1 in Example 1. The result was ΔVL=+12 V.

Example 30

Evaluation of variation in bright part potential was conducted in the same manner as in Example 1 except that the electrophotographic photosensitive member D30 was used in place of the electrophotographic photosensitive member D1 in Example 1. The result was ΔVL=+12 V.

Example 31

Evaluation of variation in bright part potential was conducted in the same manner as in Example 1 except that the electrophotographic photosensitive member D31 was used in place of the electrophotographic photosensitive member D1 in Example 1. The result was ΔVL=+12 V.

Example 32

Evaluation of variation in bright part potential was conducted in the same manner as in Example 1 except that the electrophotographic photosensitive member D32 was used in place of the electrophotographic photosensitive member D1 in Example 1. The result was ΔVL=+12 V.

As shown in Table 1, the electrophotographic apparatuses each including an electrophotographic photosensitive member of Examples containing (α) a metal oxide particle, (β) a benzophenone compound represented by formula (1) and (γ) a compound represented by formula (2) in the undercoat layer have less variation in bright part potential and maintain the electrical property more favorably in the repetitive use after the electrophotographic apparatuses were left to stand under a high-temperature and high-humidity environment when compared with the electrophotographic apparatuses each including an electrophotographic photosensitive member of Comparative Examples not containing the (β) or the (γ).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-071653, filed Mar. 31, 2016, and Japanese Patent Application No. 2017-043966, filed Mar. 8, 2017, which are hereby incorporated by reference herein in their entirety.

What is claimed is:

1. An electrophotographic apparatus comprising:

an electrophotographic photosensitive member;

a charging roller disposed so as to abut on the electrophotographic photosensitive member; and a charging unit charging the electrophotographic photosensitive member by applying only a direct-current voltage, wherein the electrophotographic photosensitive member comprises:

a support;

a photosensitive layer; and an undercoat layer between the support and the photosensitive layer, the undercoat layer comprising:

(α) a metal oxide particle;

(β) a benzophenone compound represented by formula (1)

(1)

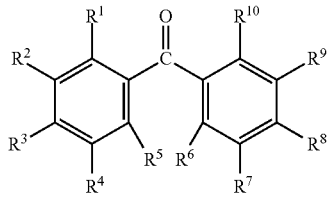

wherein $R^1$ to $R^{10}$ each independently represent a hydrogen atom, a hydroxy group, a halogen atom, an alkyl group, an alkoxy group or an amino group, provided that at least 3 of $R^1$ to $R^{10}$ is a hydroxy group; and (γ) a compound represented by formula (2)

(2)

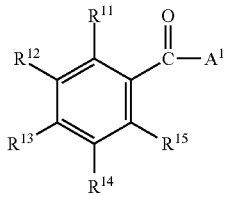

wherein $R^{11}$ to $R^{15}$ each independently represent a hydrogen atom, a hydroxy group, a halogen atom, an alkyl group, an alkoxy group or an amino group and $A^1$ represents an alkenyl group having 2 to 4 carbon atoms.

2. The electrophotographic apparatus according to claim 1, wherein the (α) is a metal oxide particle comprising a zinc oxide particle.

3. The electrophotographic apparatus according to claim 1, wherein the (β) is a benzophenone compound wherein 2 adjacent groups of $R^6$ to $R^{10}$ in the formula (1) are hydroxy groups.

4. The electrophotographic apparatus according to claim 1, wherein the (γ) is a compound wherein $A^1$ in the formula (2) is a 1-propenyl group.

5. The electrophotographic apparatus according to claim 1, wherein a content of the (β) in the undercoat layer is 0.1 to 4.0% by mass relative to a content of the (α) in the undercoat layer.

6. The electrophotographic apparatus according to claim 1, wherein a content of the (γ) is 1.0 to 15% by mass relative to a content of the (β) in the undercoat layer.

7. A process for producing an electrophotographic photosensitive member comprising a support, a photosensitive layer, and an undercoat layer between the support and the photosensitive layer, the process comprising:

forming a coating film through coating with a coating liquid for an undercoat layer; and drying the coating film, thereby forming the undercoat layer, wherein the coating liquid for an undercoat layer comprises:

(α) a metal oxide particle;

(β) a benzophenone compound represented by formula (1)

(1)

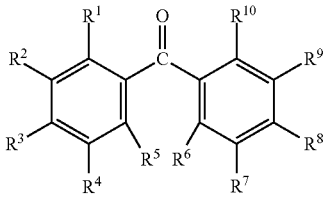

wherein $R^1$ to $R^{10}$ each independently represent a hydrogen atom, a hydroxy group, a halogen atom, an alkyl group, an alkoxy group or an amino group, provided that at least 3 of $R^1$ to $R^{10}$ is a hydroxy group;

(γ) a compound represented by formula (2)

(2)

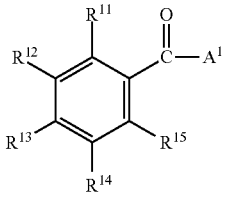

wherein $R^{11}$ to $R^{15}$ each independently represent a hydrogen atom, a hydroxy group, a halogen atom, an alkyl group, an alkoxy group or an amino group and $A^1$ represents an alkenyl group having 2 to 4 carbon atoms; and (δ) water, wherein a water content of the coating liquid for an undercoat layer is 2 to 10% by mass relative to a total mass of the coating liquid for an undercoat layer.

8. The process for producing an electrophotographic photosensitive member according to claim 7, wherein the (α) is a metal oxide particle comprising a zinc oxide particle.

9. The process for producing an electrophotographic photosensitive member according to claim 7, wherein the (β) is a benzophenone compound wherein 2 adjacent groups of $R^6$ to $R^{10}$ in the formula (1) are hydroxy groups.

10. The process for producing an electrophotographic photosensitive member according to claim 7, wherein the (γ) is a compound wherein $A^1$ in the formula (2) is a 1-propenyl group.

11. The process for producing an electrophotographic photosensitive member according to claim 7, wherein a content of the (β) in the undercoat layer is 0.1 to 4.0% by mass relative to a content of the (α) in the undercoat layer.

12. The process for producing an electrophotographic photosensitive member according to claim 7, wherein a content of the (γ) is 1.0 to 15% by mass relative to a content of the (β) in the undercoat layer.

* * * * *